US008202205B2

(12) United States Patent
Reade

(10) Patent No.: US 8,202,205 B2
(45) Date of Patent: Jun. 19, 2012

(54) OMNI-DIRECTIONAL EXERCISE DEVICE

(75) Inventor: Catherine Reade, Highlands Ranch, CO (US)

(73) Assignee: GoBe Healthy, LLC, Highlands Ranch, CO (US)

( * ) Notice: Subject to any disclaimer, the term of this patent is extended or adjusted under 35 U.S.C. 154(b) by 152 days.

(21) Appl. No.: 12/703,059

(22) Filed: Feb. 9, 2010

(65) Prior Publication Data

US 2011/0195821 A1 Aug. 11, 2011

(51) Int. Cl.
*A63B 21/00* (2006.01)

(52) U.S. Cl. ..... 482/124; 482/121; 482/126; 482/79; 482/80; 482/49

(58) Field of Classification Search ..... 482/79, 482/80, 49, 126, 121
See application file for complete search history.

(56) References Cited

U.S. PATENT DOCUMENTS

| | | | | |
|---|---|---|---|---|
| 2,760,774 | A * | 8/1956 | Perez | 482/79 |
| 5,921,900 | A * | 7/1999 | Mankovitz | 482/121 |
| 5,957,816 | A * | 9/1999 | Staffa | 482/70 |
| 6,277,057 | B1 * | 8/2001 | Hayden | 482/79 |
| 6,283,897 | B1 * | 9/2001 | Patton | 482/79 |
| 6,821,235 | B1 * | 11/2004 | Johnson et al. | 482/79 |
| 6,935,991 | B1 * | 8/2005 | Mangino | 482/51 |
| 7,322,914 | B1 * | 1/2008 | Vittone et al. | 482/146 |
| 2004/0035025 | A1 * | 2/2004 | Choi | 36/132 |

* cited by examiner

*Primary Examiner* — Jerome W Donnelly
(74) *Attorney, Agent, or Firm* — Perkins Coie LLP

(57) ABSTRACT

This disclosure describes, generally, an omni-directional exercise device. The device includes a platform base, and resistance bands coupled to the platform base. The device further includes at least two enclosures coupled to the plurality of resistance bands. The two enclosures are positioned on top of the platform base at a home position. The two enclosures are configured to slide on top of the platform base in a 360-degree range of motion such that the plurality of resistance bands provide resistance at any point on the platform base and are configured to return to the home position.

20 Claims, 8 Drawing Sheets

OMNI-DIRECTIONAL EXERCISE DEVICE

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD OF THE INVENTION

The present invention relates, in general, to exercise devices and, more particularly, to an omni-directional exercise device.

BACKGROUND

Societies today live a high-tech sedentary lifestyle with little or no time for exercise. A large majority of the world's population spends time in front of computers (or other electronic devices) to perform work or personal tasks on a daily basis. Workers share a significant dependence on computers to efficiently and effectively expedite their work. This has created work and home environments where long hours are spent sitting in front of a computer or at a desk. As a result, health has suffered as evidenced by the rise of chronic lifestyle conditions like heart disease, obesity, and diabetes. Health experts agree that more activity should be introduced into a sedentary lifestyle for better health.

Attempting to find time to exercise can add stress to an already over-stressed schedule of work, family, and community commitments. It is often impossible to get away from the workplace to exercise. Office workers and others may be left with sluggish metabolisms, lethargy, and general discomfort and, as a result, may exhibit poor productivity. Long hours at the computer are becoming more prevalent. Worldwide, it is estimated that half of the workforce from developed countries will be working at computers. Accordingly, people need an exercise device that is convenient, effective, inexpensive and easy to use, without any extra time investment required. A device is needed for a user to utilize whenever desired while the user simultaneously performs office work like talking on the phone, answering emails, searching the internet, doing research, writing documents, reading or other myriad office tasks. Hence, improvements in the art are needed.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components. In some instances, a sub-label is associated with a reference numeral to denote one of multiple similar components. When reference is made to a reference numeral without specification to an existing sub-label, it is intended to refer to all such multiple similar components.

SUMMARY OF THE INVENTION

Figure 1:
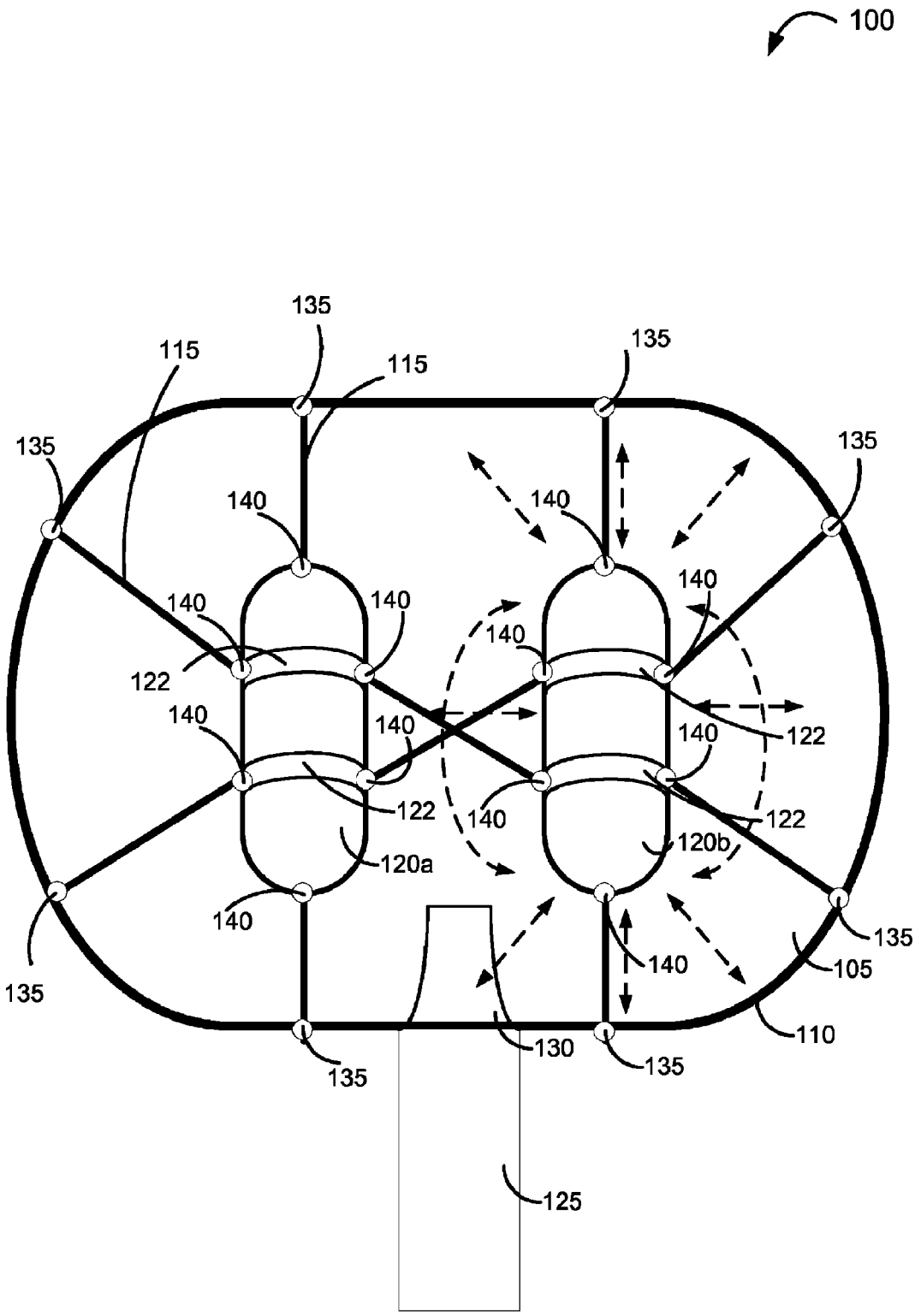
FIG. 1 is a block diagram illustrating a top-view of an omni-directional exercise device, in accordance with one embodiment of the present invention.

This disclosure describes, generally, an omni-directional exercise device. The device includes a platform base, and resistance bands coupled to the platform base. The device further includes at least two enclosures coupled to the plurality of resistance bands. The two enclosures are positioned on top of the platform base at a home position. The two enclosures are configured to slide on top of the platform base in a 360-degree range of motion such that the plurality of resistance bands provide resistance at any point on the platform base and are configured to return to the home position.

DETAILED DESCRIPTION OF THE INVENTION

While various aspects of embodiments of the invention have been summarized above, the following detailed description illustrates exemplary embodiments in further detail to enable one of skill in the art to practice the invention. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form. Several embodiments of the invention are described below and, while various features are ascribed to different embodiments, it should be appreciated that the features described with respect to one embodiment may be incorporated with another embodiment as well. By the same token, however, no single feature or features of any described embodiment should be considered essential to the invention, as other embodiments of the invention may omit such features.

Aspects of the present invention relate to an omni-directional exercise device that provides isometric and/or dynamic activity for a user while seated and simultaneously working at a computer, desk, or the like. The device can be used for toning, strengthening, rehabilitation, etc. of a wide range of muscles of the lower body (e.g. the feet, ankles, shins, calves, knees, quadriceps, hamstrings, inner and outer thighs, gluteus, hips, etc.) and/or the upper body (e.g., the arms, biceps, triceps, pectorals, etc.). In one embodiment, the exercise device may include a platform with two foot/hand enclosures in the center with elastic-type bands that attach from the foot/hand enclosures to the platform in order to provide resistance. The platform may have a small notch in the center of the lower part of the platform to receive one leg and caster of, for example, an office chair so that the device sits conveniently at the user's feet.

The foot/hand enclosures may be attached to the platform and connected to one another with elastic-type resistance bands in a unique configuration that provides for 360 degrees of omni-directional movement patterns where the exercises performed can be isometric, dynamic or both. One band may attach from each toe and heel portion; two bands may attach from each lateral part of the foot enclosures with center bands in an "X" configuration that connect the right and left foot enclosures to each other, thus, providing for a unique feel and resistive force. The bands can be adjusted in length and thickness to provide different levels of resistance to meet the preferences and varying needs of the user. The platform may be constructed of a smooth, low-friction surface that provides a quiet slide of the foot enclosures over the platform.

Furthermore, users can move their feet in virtually limitless omni-directional patterns. Patterns performed may include, but are not limited to, forward and back movements (leg flexion and extension); lateral out and in moves (leg abduction and adduction); circular clockwise and counterclockwise moves for the inner and outer thighs plus hips and gluteals; heel and toe raises for the calves and shins respectively; pivoting foot motions to strengthen various muscles of the ankles; and many more combinations thereof.

By altering the position or angle of the feet during the exercises, the user can activate different muscles. In addition, exercises can be performed isometrically, dynamically or both at the same time. For example, inner thighs can be strengthened isometrically by performing leg adduction and holding the inner thighs together for a period of time, while the inner thighs can be dynamically activated with lateral motions going to the outside of the platform and then sliding inwards. A combination of both isometric and dynamic activity can be done when the thighs are brought together and held as in isometric leg adduction and then adding a dynamic movement of the feet sliding in a forward and backward motion (leg extension and flexion).

Furthermore, benefits of the present invention are that the device appeals to a broad range of users including those living a sedentary lifestyle to trained athletes. For those individuals who are overweight or obese, it is a great place to start exercising since it is easy to slip in and out of, is non-weight-bearing so no extra stress is placed on painful joints, and it conveniently sits at the user's feet so it can be used whenever desired and in the privacy of the user's office or home. For individuals who experience poor circulation or inflammation, the present invention helps improve these conditions. Peer-reviewed research indicates that exercise decreases inflammation and the pain that goes along with it. Athletes can use the device to supplement their training which may improve sports performance as it strengthens macro- and micro-muscles around joints, particularly ankles and knees. The device may also be used to rehabilitate injured muscles. The device is lightweight and portable so it can be easily handled by anyone in the home, in the office or for travel. It is inexpensive and versatile, providing isometric and/or dynamic activity where the user chooses the resistance and pace. Toning, strengthening or rehabilitation of the lower and/or upper body can be achieved safely from the comfort of a chair. The user will be burning more calories daily, resulting in weight loss or maintenance of a healthy weight. An energy boost both physically and mentally is also experienced. These positive effects will lead to an enhanced level of fitness with a concomitant quality of life improvement for the user. All of these health benefits without any extra time investment required make it perfect for anyone.

Turning now to FIG. 1, which illustrates an omni-directional exercise device 100, in accordance with one embodiment of the present invention. The device 100 may include a platform base 105. In one embodiment, platform base 105 may be constructed of a durable, low-friction, smooth material (e.g., a polymer plastic, wood, metal, stainless steel or other material to create as frictionless a surface as possible). Platform base 105 may be of sufficient thickness and weight to prevent movement of platform base 105, but light enough for easy portability. Further, platform base 105 may be flat and oval or semi-oval shaped; however, other suitable shapes may be used. Dimensions of platform base 105 may vary, for example, from 35 to 28 inches wide, 20 to 25 inches deep. These dimensions are approximate and may increase or decrease for this and/or other embodiments.

Platform base 105 may include a rounded edge 110 and attachment points 135 which may be configured to create less friction and/or stress on resistance bands 115, thus increasing longevity. In one embodiment, resistance bands 115 may be made from an elastic-type material which would provide resistance. Resistance bands 115 may attach from attachment points 140 on foot enclosures 120*a* and 120*b* to attachment points 135 on platform base 105. In a further embodiment, attachment points 140 on foot enclosures 120 may be positioned at the center of the heel and toe areas with two points on the outside areas and two points that crisscross in the center areas, thus attaching foot enclosure 120*a* to foot enclosure 120*b*.

The level of difficulty (or amount of resistance) can be adjusted by differing the length, thickness, and type of material of resistance bands 115. For example, the resistance of the bands can be adjusted to meet the varying and changing needs of the user. This may be achieved by variation in length and thickness of resistance bands 115, such that the longer and/or thinner the bands, the lighter the resistance, and conversely the shorter and/or heavier the bands, the higher the resistance. Tension can also be adjusted to meet the varying and changing needs of the user. Tension can be set at differing levels from lax to taut with lax being the easiest and taut being the more challenging tension. The resistance level of resistance bands 115 may gradually increase from extra light, light, moderate, challenging levels, and so forth of resistance based on the condition of the user. In one embodiment, equal tension for all bands is provided for smooth operation of the device. In one embodiment, resistance bands may be constructed from Polypropylene cord, latex cord, neoprene cord, or the like.

Furthermore, resistance bands 115 may be removed. For example, for unconditioned users, the toe and/or heel bands may not need to be used initially, thus making the movements much easier. When sufficient strength is gained, these bands can be attached for an additional muscular challenge and to achieve further strengthening of a wider range of lower body muscles. For example, a set of 10 bands may include: 2 toe; 2 heel; 4 lateral; and 2 center bands, and a pack of three sets of bands of graduated resistance may be included to meet the preferences and changing needs of the user. The lightest resistance bands may be the longest while the most challenging bands may be the shortest.

Figure 3A:
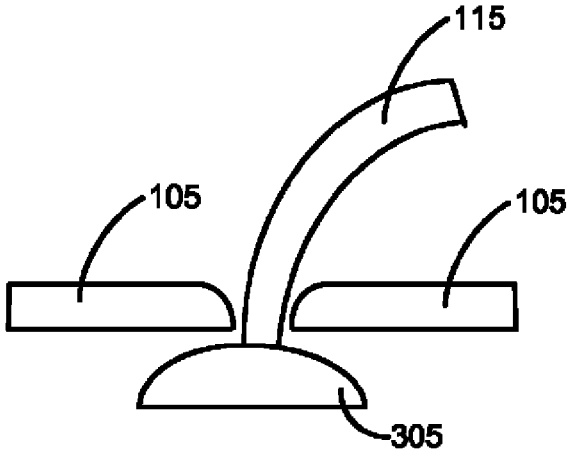
FIGS. 3A, 3B, and 3C are block diagrams illustrating foot enclosures, in accordance with one embodiment of the present invention.

In one embodiment, resistance bands 115 may have bulbous ends (see, for example, FIG. 3A, reference number 305) that may easily slide into attachment points 135 and 140 on foot enclosures 120*a* and 120*b* and platform base 105. Further, the slit in FIG. 3A may be in a semi-circular underside area cut out, and resistance band 115 may slide through the slit. The bulbous end 305 is then secured in the semi-circular opening.

Platform base 105 may further include a notch 130 at the center of platform base 105. Notch 130 may be configured to receive a chair base (not shown), or the like. In one embodiment, the interior portion of notch 130 may measure 2 to 4 inches and may be graduated from the exterior portion measuring between 3 to 5 inches, in order to receive the office chair caster. Nonetheless, the size and dimensions of notch 130 may be adjusted accordingly to accommodate various chair sizes and configurations. Device 100 may further include a guide 125. Guide 125 may be configured to guide a chair base into notch 130, in order to provide for easy seating of the chair.

In an alternative embodiment of the present invention, omni-directional device 100 may be placed on the user's lap or other flat surface, and foot enclosures 120 may alternatively be used as hand enclosures. Accordingly, the user may use the device in the same or similar way as used with the feet, but instead for working the upper body muscle groups.

In a further alternative embodiment, at guide 125, instead of sliding a chair base into omni-directional device 100, a handle and post may be used. For example, the user may stand on the device and use the handle and post for balance and support.

Figure 2:
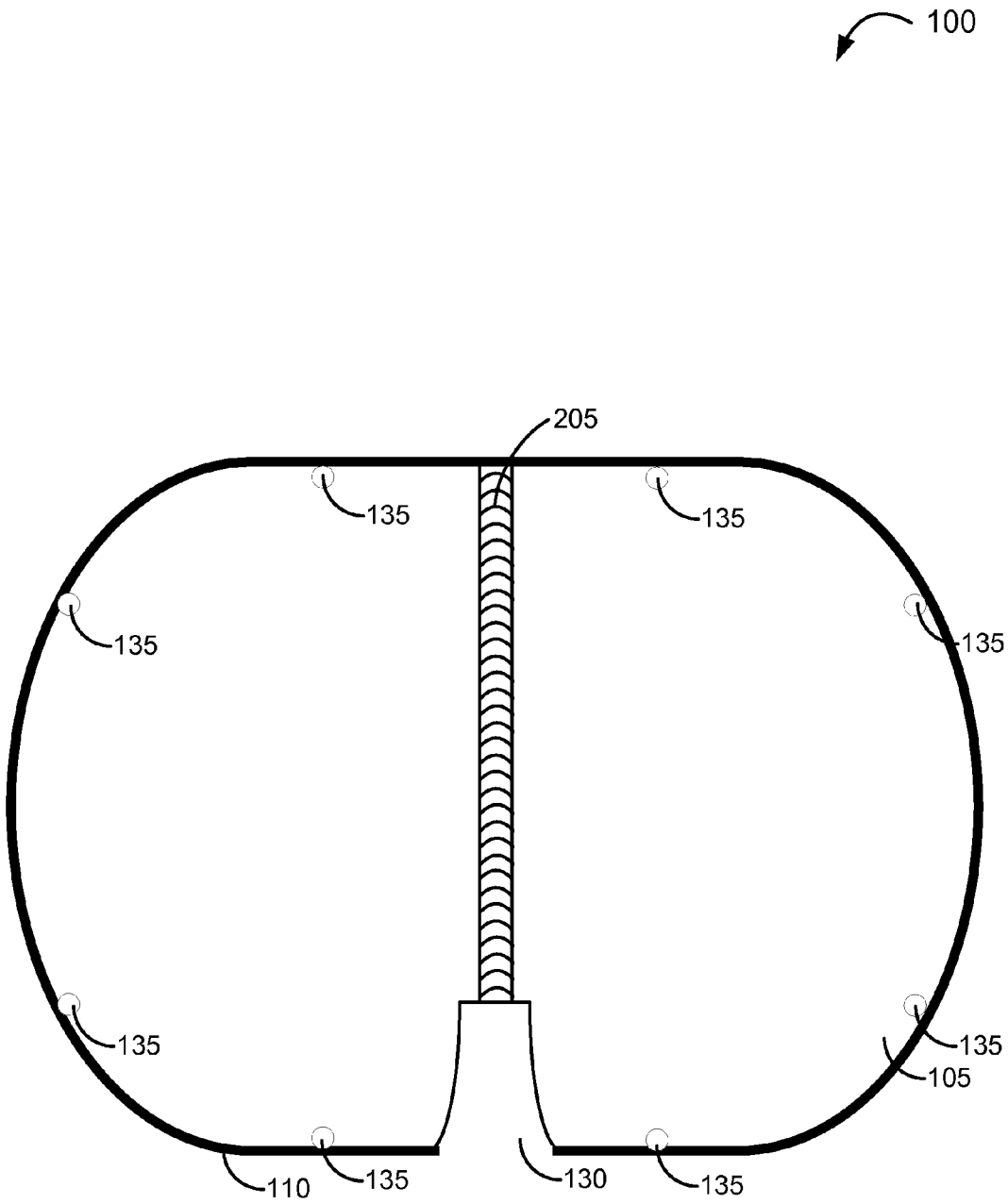
FIG. 2 is a block diagram illustrating a bottom-view of an omni-directional exercise device, in accordance with one embodiment of the present invention.

Turning now to FIG. 2, which illustrates the bottom portion of device 100, in accordance with aspects of the present invention. Platform base 105 may have center hinges 205, allowing platform base 105 to fold to half its size for travel use and greater portability. The underside of platform base 105 may have a rubber resistant coating to allow the device to grab the floor surface to prevent movement of the base. Alternatively, other adhesive or high gripping of friction materials may be used to reduce or eliminate slipping of platform base 105. Furthermore, attachment points 135 for resistance bands 115 may be located on the underside of platform base 105.

Figure 3B:
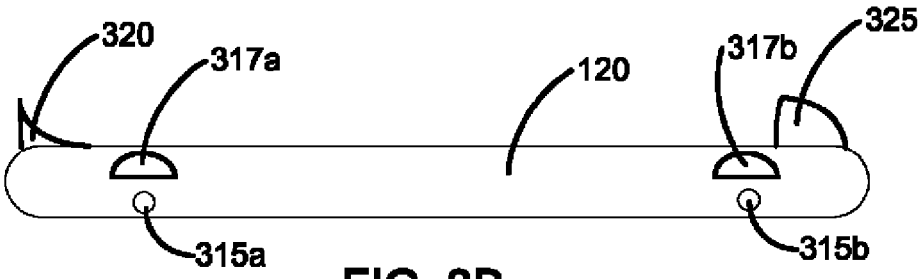
Figure 3C:
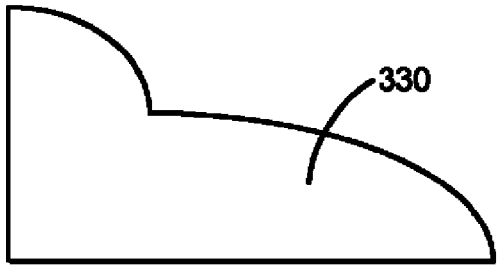

FIGS. 3B and 3C illustrate embodiments of foot enclosures 120*a* and 120*b*. In one embodiment, foot enclosures 120*a* and 120*b* may sit in the center of platform base 105 with resistance bands 115 attached in the center of the toe and heel areas; and two bands connected to the outside portion of each foot; and two center bands are crisscrossed effectively attaching the right and left shoes to each other. The length and tension of the band may vary with the type of elastic resistance band used, fitness level of the user and to a lesser extent, the size of the shoe. Further, the bigger the shoe, the shorter the band length becomes incrementally. The foot enclosure will come in small, medium and large sizes to accommodate different shoe sizes of the user. Each foot enclosure can be adjusted to the correct size for a custom, snug fit for each individual user. This will be achieved by a sliding mechanism found in the center of the foot bed that can be locked into place. The first size adjustment is all that will be needed prior to its use.

In one embodiment, foot enclosures 120 may be constructed from a durable material, like a polymer plastic, wood or wood derivative or other similar material. Adjustable straps 122, a heel cup 320, and toe receptacle 325 are provided to stabilize each foot and prevent wiggling within the enclosure for a smooth activity experience. Foot enclosures 120 also allow the user to simply slip in and out of an enclosure 330, without any adjustments required after the initial sizing and personal customization. For example, as shown in FIG. 3C, the bare foot, stocking foot, shoe, etc. may be completely (or nearly completely) enclosed in enclosure 330.

Furthermore, straps 122 may have Velcro-type attachment points or other adjustable means such that a snug fit around the foot is achieved. Foot enclosures 120 may also be configured to receive a flat shoe or a bare foot. For example, for users who prefer to use the device with a bare or a stocking foot, a slipper-type insert may also be used. The insert may be made from soft, cushioning materials (e.g., a gel, foam, etc.) that will provide an extremely comfortable fit.

In a further embodiment, the center resistance bands 115 may attach to the interior of foot enclosures 120 at the center point of the heel and mid-foot. The center band may be configured in a cross configuration (X) and provide a unique resistance when in motion. Resistance bands 115 on the exterior portion of foot enclosure 120 may be attached with attachment points 315*a*, 317*a* and 315*b*, 317*b*, which may line up with the center attachment points at the mid-heel and mid-foot. These bands may extend diagonally from the foot enclosure to the underside of platform base 105, where they attach by sliding the bulbous end 305 into a notched area and can provide varying resistance.

Figure 4A:
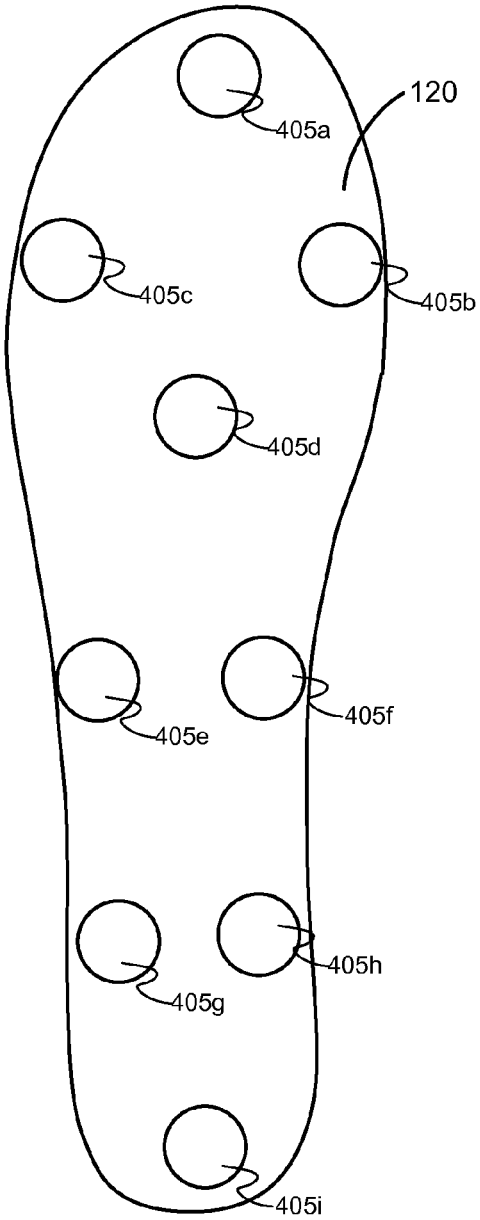
FIGS. 4A and 4B are block diagrams illustrating foot enclosures, in accordance with further embodiments of the present invention.
Figure 4B:
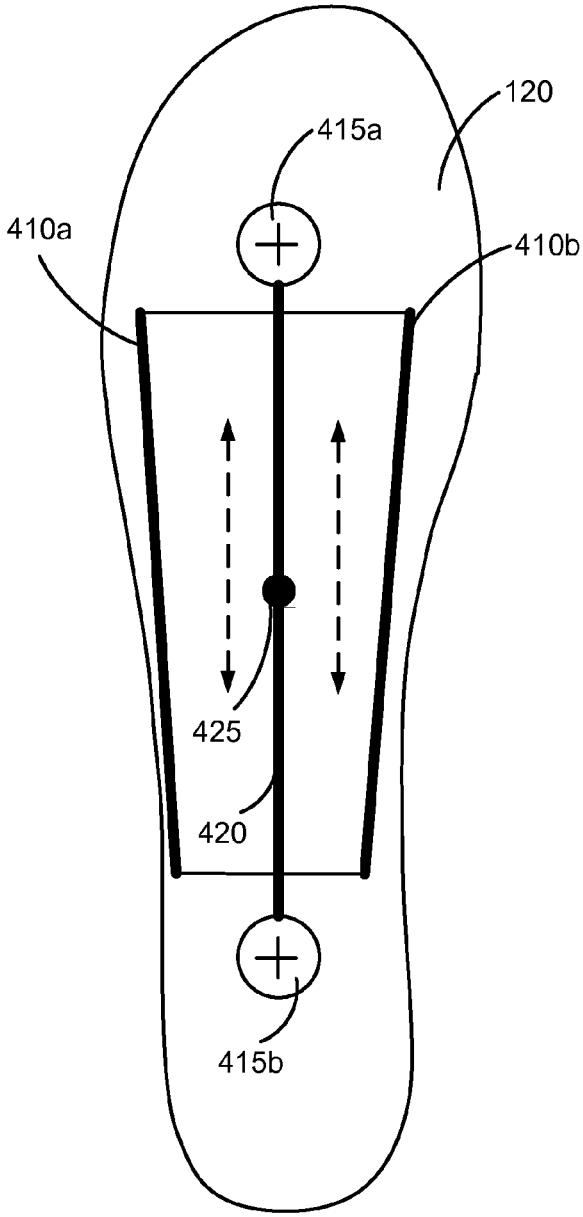

Turning now to FIGS. 4A and 4B, which illustrates embodiments of foot enclosures 120. In one embodiment, foot enclosures 120 may include contact points 405*a*-405*i*, which may be configured to provide low-friction contact between foot enclosures 120 and platform base 105. Contact points 405*a*-405*i* may be placed in any configuration and the number of contact points may be increased or decreased. The material used for contact points 405 may be a low friction material, such felt, rubber, plastic, or other similar low friction materials may also be configured in a variety of ways. For example, contact points 405 may be configured in such a way as to provide support for the user, alternatively may be configured to optimize the exercise capability of omni-directional exercise device 100.

Referring now to FIG. 4B, which includes support bars 410*a* and 410*b*, mounts 415*a* and 415*b*, and adjustment mechanisms 420 and 425. In one embodiment, support bars 410*a* and 410*b* may be used to provide support to the user's feet, as well as provide balance for the user. Mounts 415*a* and 415*b* may be configured to lock in adjustment mechanism 420 and 425. In one embodiment, adjustment mechanisms 420 and 425 may provide a sliding size adjustment for foot enclosures 120, in order to accommodate for varying foot sizes.

Figure 5A:
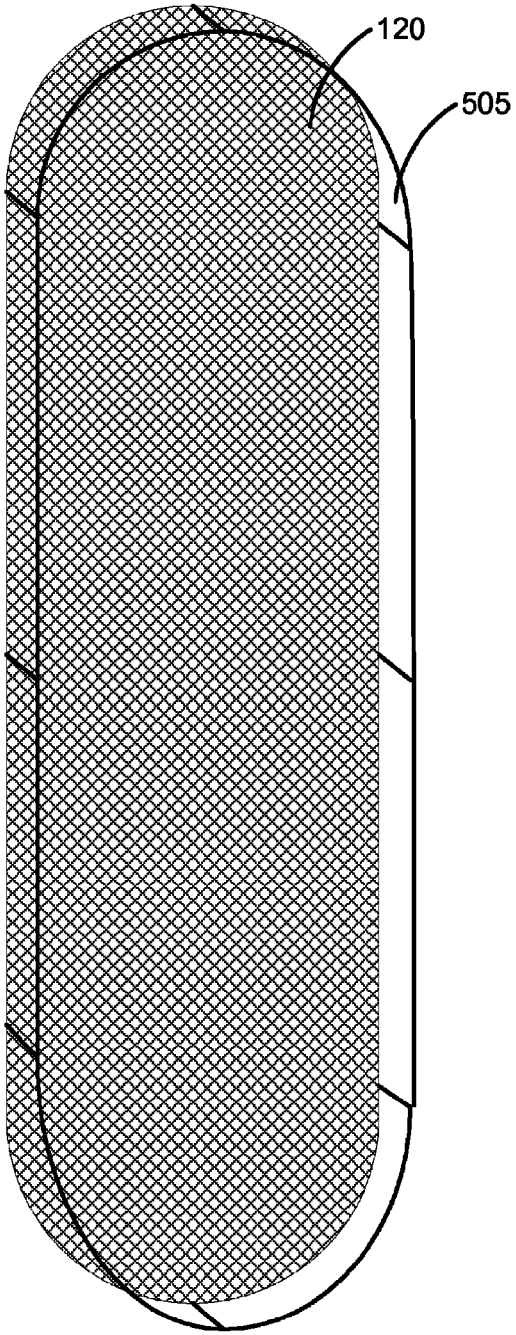
FIGS. 5A and 5B are block diagrams illustrating foot enclosures, in accordance with yet another embodiment of the present invention.

FIG. 5A further illustrates foot enclosures 120. In a further embodiment, foot enclosures 120 may have a strapless design. Rim 505 may be configured to accommodate the user's foot and eliminate the possibility of the user's foot sliding off of foot enclosures 120. Furthermore, the material used for foot enclosures 120 may be a rubber grip, or the like to provide additional grip and traction. Alternatively, gel-like cells may be used to provide additional grip between the user's foot and foot enclosures 120.

Figure 5B:
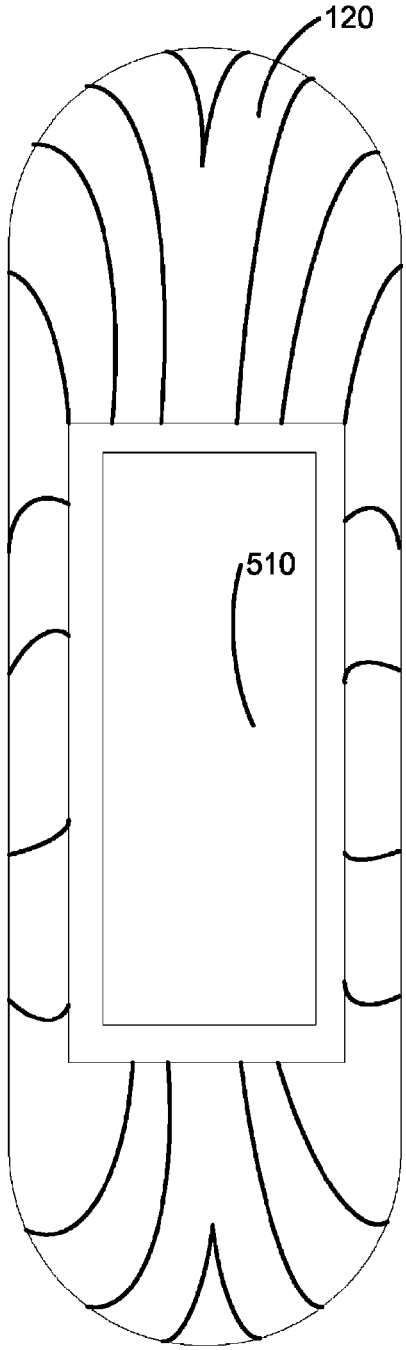

Furthermore, FIG. 5B illustrates an alternative bottom view of foot enclosures 120. As illustrated in FIG. 5B, the bottom portion of foot enclosure 120 may be slightly curved to provide a gradual incline to a central point 510 on foot enclosures 120. As such, foot enclosures 120 are still able to slide along platform base 105 at central point 510, while allowing the user to rock foot enclosures 120 in any direction. As such, the user is able to perform shin, calf, ankle and other similar exercises. For example, the user may be able to rock back onto his or her heel or toe in order to exercise his or her shin and calf muscles. In addition, resistance bands 115 can provide additional resistance for such exercises.

Figure 6A:
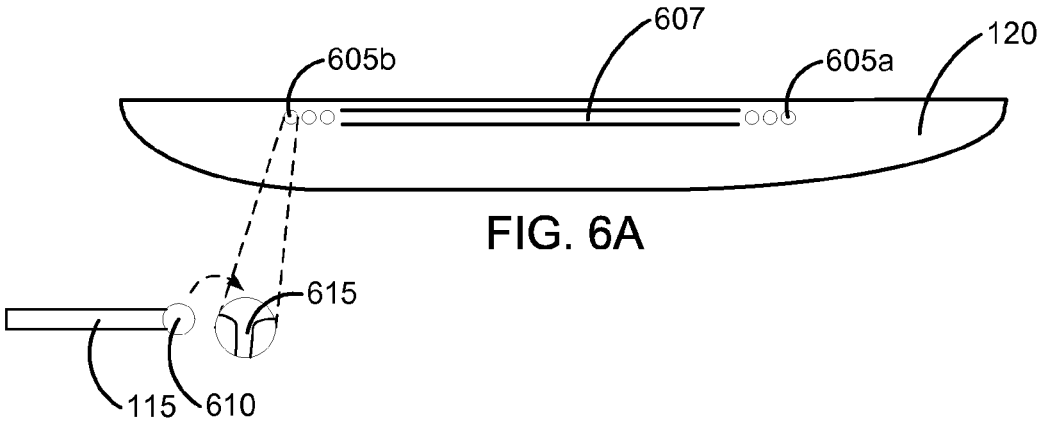
FIGS. 6A, 6B, and 6C are block diagrams illustrating foot enclosures and attachment mechanisms, in accordance with one embodiment of the present invention.
Figure 6B:
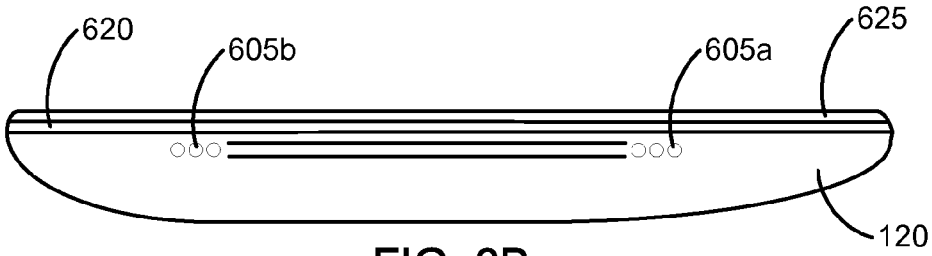

Turning next to FIGS. 6A and 6B, which illustrate attachment mechanisms for attaching resistance bands 115 to foot enclosures 120. In one embodiment, foot enclosures 120 may include a tubular section 607 and attachments points 605*a* and 605*b*. Tubular section 607 may be configured to have resistance bands 115 extend through tubular section 607 in order to adjust the tension strength of resistance bands 115. Further, tubular section 607 is able to house one larger band as opposed to two shorter bands which would each be attached at separate attachment points 605*a* and 605*b*.

Attachment points 605 includes an open cut-out section 615 which provides a lock-in place for a bulbous end 610 of resistance bands 115. In one embodiment, bulbous end 610 locks in behind open cut-out 615, thus locking resistance bands 115 into place.

Figure 6C:
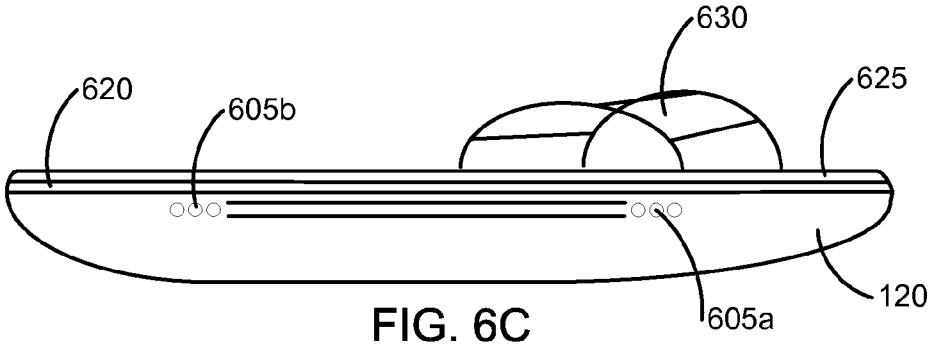

Furthermore, FIG. 6B may include layers 620 and 625 on top of foot enclosures 120. For example, layer 620 may be a semi-soft rubber (or other suitable material) layer, and layer 625 may be a cushion and grip layer configured to provide comfort and support, as well as grip for the user. Furthermore, FIG. 6C illustrates a strap 630 which may be included to provide additional stability for the user.

Figure 7:
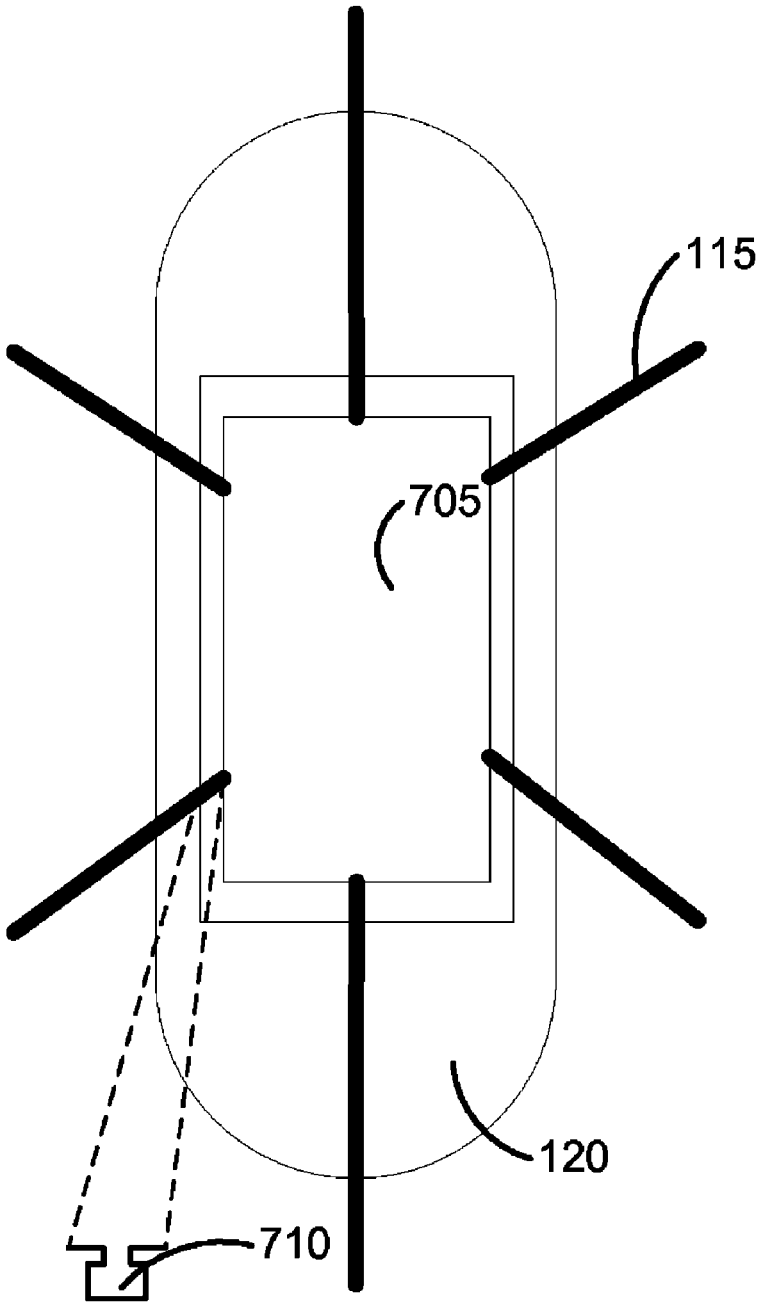
FIG. 7 is a block diagram illustrating attachment mechanisms, in accordance with yet another embodiment of the present invention.

Turning now to FIG. 7, which illustrates an alternative attachment configuration for attaching resistance bands 115 to foot enclosures 120. In one embodiment, resistance bands 115 may be connected at a base 705 at the bottom of foot enclosures 120. Resistance bands 115 may be "notched" in place using a notch 710, as shown in FIG. 7. Nonetheless, alternative notching configurations may be used.

Figure 8:
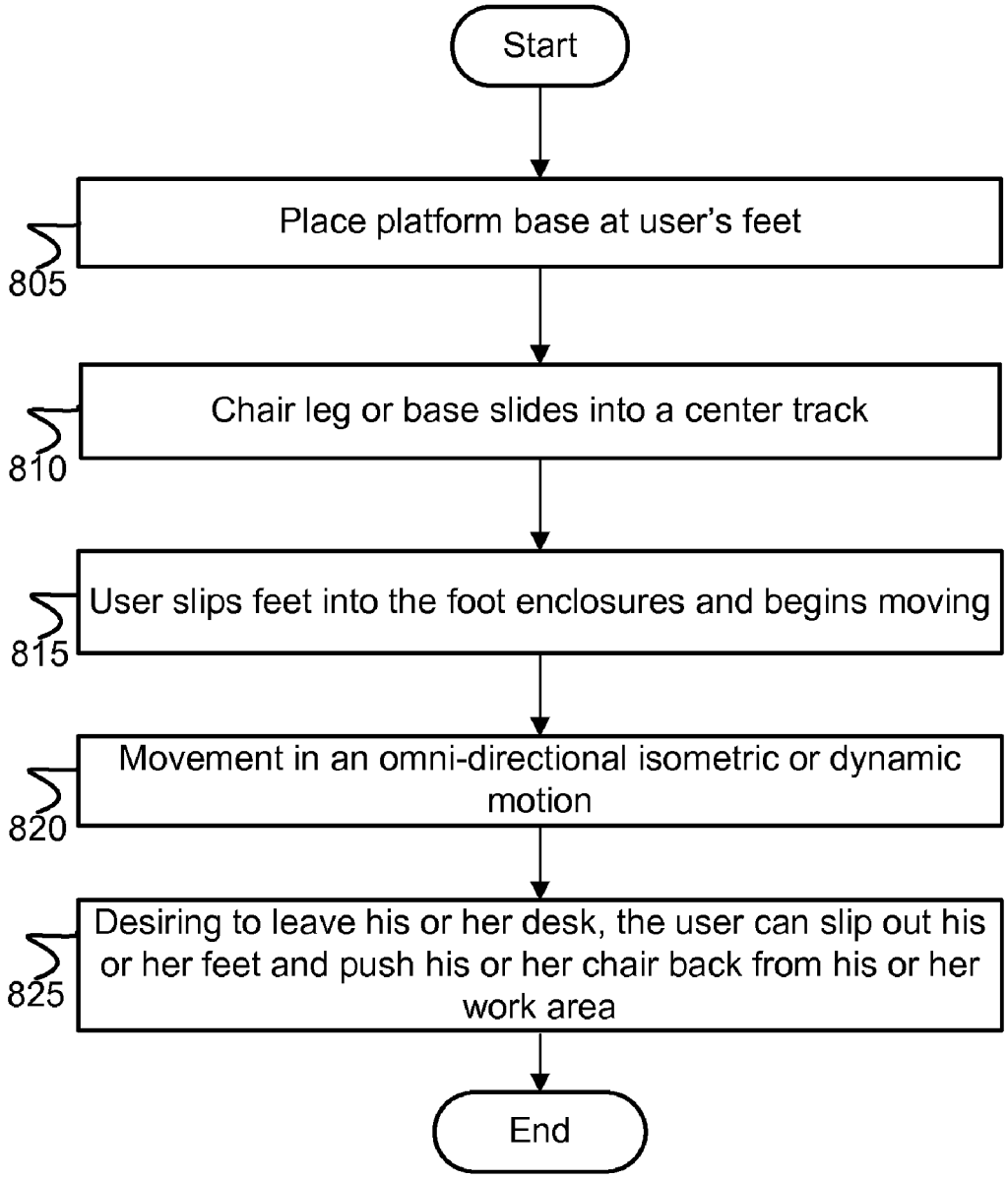
FIG. 8 is a flow diagram illustrating a method of using an omni-directional exercise device, in accordance with another embodiment of the present invention.

Turning next to FIG. 8, which illustrates a method 800 for using omni-directional exercise device 100. At process block 805, the platform base (FIG. 1) is placed at the user's feet. At process block 810, the chair leg or base slides into a center track (FIG. 1) and the device is used with ankles comfortably placed below knees forming a 90-degree angle at home position. At process block 815, the user can slip his or her feet into the foot enclosures (FIG. 1) and begin moving at his or her own pace. Once the user's feet are snugly in the foot enclosures, the user can choose when and how to move. Movements are omni-directional where the feet and legs can move isometrically (static position held) or dynamically (joints and muscles are moving) or perform both movements simultaneously (process block 820). Movement pattern examples include but are not limited to the following: out and in laterally (leg abduction and adduction), forward and back (leg extension and flexion), clockwise and counterclockwise circular patterns (large and small); heel raises; toe raises; changing the angle of the feet whereby the muscles used change as with a toe lift; pivoting motions of toes with the heels stable and vice versa; foot and leg lifts; legs and feet can be moved alternately or simultaneously.

The movement patterns are chosen by the user allowing them to customize their activity, moving as much or as little as desired. Most movements may be sustained for short intervals ranging from 30 seconds to a few minutes depending on the exercise and preferences of the user. At process block 825, when the user desires to leave his or her desk, he or she can slip his or her feet out without any adjustments; push his or her chair back from his or her work area where the caster rolls back on the track. When the user returns to his or her desk, he or she rolls forward with the caster in the track, assumes a comfortable and good posture and resumes the movement activity of his or her choice.

Furthermore, initial set up consists of adjusting the foot enclosure to a user's foot size using a slider mechanism that sits under the foot bed (FIG. 4B), then choosing the preferred tension of the resistance bands (extra light, light, medium or heavy, etc.), and then attaching the resistance bands to the foot enclosures and corresponding attachment points on the platform base.

While the invention has been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods of the invention are not limited to any particular structural and/or functional architecture but instead can be implemented on any suitable hardware, firmware, and/or software configuration. Similarly, while various functionalities are ascribed to certain system components, unless the context dictates otherwise, this functionality can be distributed among various other system components in accordance with different embodiments of the invention.

Moreover, while the procedures comprised in the methods and processes described herein are described in a particular order for ease of description, unless the context dictates otherwise, various procedures may be reordered, added, and/or omitted in accordance with various embodiments of the invention. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with- or without-certain features for ease of description and to illustrate exemplary features, the various components and/or features described herein with respect to a particular embodiment can be substituted, added and/or subtracted from among other described embodiments, unless the context dictates otherwise. Consequently, although the invention has been described with respect to exemplary embodiments, it will be appreciated that the invention is intended to cover all modifications and equivalents within the scope of the following claims.

What is claimed is:

1. An omni-directional exercise device comprising:

a platform base;

a plurality of resistance bands coupled to the platform base; and at least two enclosures coupled to the plurality of resistance bands, wherein the two enclosures are positioned on top of the platform base at a home position, and wherein the two enclosures are configured to slide on top of the platform base in a 360-degree range of motion such that the plurality of resistance bands provide resistance at any point on the platform base and are configured to return to the home position.

2. An omni-directional exercise device as in claim 1, wherein the plurality of resistance bands are constructed using one or more of the following: polypropylene cord, latex cord, and neoprene cord.

3. An omni-directional exercise device as in claim 1, wherein the plurality of resistance bands are configured to be adjusted to alter the level of resistance.

4. An omni-directional exercise device as in claim 3, wherein the level of resistance comprises a low level, a medium level, and a high level.

5. An omni-directional exercise device as in claim 1, wherein the platform base further comprises a plurality of connection points configured for coupling the plurality of resistance bands to the platform base.

6. An omni-directional exercise device as in claim 1, wherein the two enclosures comprise foot enclosures.

7. An omni-directional exercise device as in claim 1, wherein the two enclosures comprise hand enclosures.

8. An omni-directional exercise device as in claim 1, wherein the two enclosures comprise a plurality of connection points configured for coupling the plurality of resistance bands to the two enclosures.

9. An omni-directional exercise device as in claim 8, wherein the two enclosures are placed side-by-side on the platform base at the home position.

10. An omni-directional exercise device as in claim 9, wherein a first connection point is at the front of each enclosure, a second connection point is at the back of each enclosure, third and fourth connection points are placed at an outside position of each enclosure, and fifth and sixth connection points are placed at an inside position of each enclosure.

11. An omni-directional exercise device as in claim 10, wherein a first end of a first resistance band of the plurality of resistance bands is coupled to the fifth connection point of the first enclosure and a second end of the first resistance band is coupled to the sixth connection point of the second enclosure, and wherein a first end of a second resistance band is coupled to the sixth connection point of the first enclosure and a second end of the second resistance band is coupled to the fifth connection point of the second enclosure, such that the first and second resistance bands form an X between the first and second enclosures.

12. An omni-directional exercise device as in claim 1, wherein the two enclosures comprise at least one strap or a shoe-like enclosure.

13. An omni-directional exercise device as in claim 1, wherein the two enclosures comprise at least two layers, wherein a first layer comprises a semi-soft rubber material, and a second layer comprises a cushion grip layer.

14. An omni-directional exercise device as in claim 1, wherein the platform base comprises a guide configured to facilitate placement of a sitting device within the omni-directional exercise device.

15. An omni-directional exercise device as in claim 1, wherein the platform base further comprises a hinge mechanism for reducing the size of the omni-directional exercise device.

16. An omni-directional exercise device as in claim 1, wherein the platform base further comprises a rounded edge configured to reduce friction placed on the plurality of resistance bands.

17. An omni-directional exercise device as in claim 1, wherein the bottom of the two enclosures comprises a curved configuration from the edges of the enclosures to a flat central base.

18. An omni-directional exercise device as in claim 17, wherein the two enclosures are configured to be lifted up at the front of the enclosures and lifted up at the back of the enclosures in a rocking motion, and the enclosures are configured to be lifted up at the sides of the enclosures in a rocking motion.

19. An omni-directional exercise device as in claim 1, wherein the two enclosures comprise raised edges.

20. An omni-directional exercise device as in claim 1, wherein the two enclosures comprise an adjustment mechanism configured to adjust the horizontal size of the two enclosures.

* * * * *